US010495275B2

(12) United States Patent
Gallo et al.

(10) Patent No.: US 10,495,275 B2
(45) Date of Patent: Dec. 3, 2019

(54) FLAME SIMULATING ASSEMBLY

(71) Applicant: Glen Dimplex Americas Limited, Cambridge (CA)

(72) Inventors: Ignazio Gallo, Cambridge (CA); Michael Jach, Kitchener (CA)

(73) Assignee: Glen Dimplex Americas Limited, Cambridge, Ontario (CA)

( * ) Notice: Subject to any disclaimer, the term of this patent is extended or adjusted under 35 U.S.C. 154(b) by 267 days.

(21) Appl. No.: 15/490,395

(22) Filed: Apr. 18, 2017

(65) Prior Publication Data

US 2018/0299086 A1 Oct. 18, 2018

(51) Int. Cl.

| | |
|---|---|
| ***F21S 10/04*** | (2006.01) |
| ***F21V 14/04*** | (2006.01) |
| ***F24C 7/00*** | (2006.01) |
| *F21V 11/00* | (2015.01) |

(52) U.S. Cl.

CPC ..... *F21S 10/046* (2013.01); *F21V 14/04* (2013.01); *F24C 7/004* (2013.01); *F21V 11/00* (2013.01)

(58) Field of Classification Search

CPC ..... F21S 10/046; F24C 7/004

See application file for complete search history.

(56) References Cited

U.S. PATENT DOCUMENTS

| | | | |
|---|---|---|---|
| 2,684,244 | A | 7/1954 | Brooks |
| 2,984,032 | A | 5/1961 | Cornell |
| 3,499,239 | A | 3/1970 | Mungo |
| 3,526,984 | A | 9/1970 | Nielsen et al. |
| 4,026,544 | A | 5/1977 | Plambeck et al. |
| 4,890,600 | A | 1/1990 | Meyers |
| 4,965,707 | A | 10/1990 | Butterfield |
| 5,642,580 | A | 7/1997 | Hess et al. |
| 6,047,489 | A | 4/2000 | Hess et al. |
| 6,050,011 | A | 4/2000 | Hess et al. |
| 6,162,047 | A | 12/2000 | Hess |
| 6,363,636 | B1 | 4/2002 | Hess et al. |

(Continued)

FOREIGN PATENT DOCUMENTS

| | | |
|---|---|---|
| GB | 414280 | 8/1934 |
| GB | 1113209 | 5/1968 |

(Continued)

OTHER PUBLICATIONS

Extended European Search Report dated Sep. 17, 2018 for European Patent Application No. 18166981.3.

*Primary Examiner* — Zheng Song

(57) ABSTRACT

A flame simulating assembly including one or more light sources for producing light, a screen to which the light from the light source(s) is directed, to provide a number of images of flames thereon viewable via a front surface of the screen, and a rotatable flicker element. The flicker element includes an elongate rod defined by an axis thereof about which the rod is rotatable. The rod is positioned at a preselected elevation above a base of the flame simulating assembly. The flicker element also includes a number of paddle elements located on the rod, for intermittently reflecting the light from the light sources from the paddle elements to the screen respectively as the flicker element rotates about the axis, to provide the images of flames on the screen. The light sources are located substantially at the preselected elevation and proximal to the flicker element.

10 Claims, 13 Drawing Sheets

(56) References Cited

U.S. PATENT DOCUMENTS

| | | | | |
|---|---|---|---|---|
| 6,385,881 | B1 | 5/2002 | Hess | |
| 6,393,207 | B1 | 5/2002 | Martin et al. | |
| 6,564,485 | B1 | 5/2003 | Hess | |
| 6,691,440 | B1 | 2/2004 | Petz et al. | |
| 6,718,665 | B2 * | 4/2004 | Hess | F21S 10/04 40/428 |
| 6,757,487 | B2 | 6/2004 | Martin et al. | |
| 6,880,275 | B2 | 4/2005 | Mix et al. | |
| 7,080,472 | B2 | 7/2006 | Schroeter et al. | |
| 7,134,229 | B2 | 11/2006 | Hess et al. | |
| 7,162,820 | B2 | 1/2007 | Hess et al. | |
| 7,210,256 | B2 | 5/2007 | Rosserot | |
| 7,373,743 | B1 | 5/2008 | Hess | |
| 7,668,442 | B2 | 2/2010 | O'Neill | |
| 7,673,408 | B2 | 3/2010 | Hess et al. | |
| 7,770,312 | B2 | 8/2010 | Stinson et al. | |
| 8,661,721 | B2 | 3/2014 | Hess et al. | |
| 8,739,439 | B2 | 6/2014 | Asofsky et al. | |
| 9,453,627 | B1 | 9/2016 | Chen | |
| 2002/0139021 | A1 | 10/2002 | Hess et al. | |
| 2003/0041491 | A1 | 3/2003 | Mix | |
| 2003/0046837 | A1 | 3/2003 | Hess | |
| 2003/0049024 | A1 | 3/2003 | Chen | |
| 2003/0110671 | A1 | 6/2003 | Hess | |
| 2003/0156828 | A1 | 8/2003 | Jamieson et al. | |
| 2004/0060213 | A1 | 4/2004 | Schroeter et al. | |
| 2004/0181983 | A1 | 9/2004 | Hess et al. | |
| 2004/0264949 | A1 | 12/2004 | Deng | |
| 2005/0097792 | A1 | 5/2005 | Naden | |
| 2006/0101681 | A1 | 5/2006 | Hess et al. | |
| 2006/0188831 | A1 | 8/2006 | Hess et al. | |
| 2006/0242870 | A1 | 11/2006 | Atemboski et al. | |
| 2007/0175074 | A1 | 8/2007 | O'Neill | |
| 2009/0126241 | A1 | 5/2009 | Asofsky | |
| 2009/0310340 | A1 * | 12/2009 | Betz | F24C 7/004 362/183 |
| 2011/0127914 | A1 | 6/2011 | Patton et al. | |
| 2012/0155075 | A1 * | 6/2012 | Asofsky | F24C 7/004 362/231 |
| 2015/0052791 | A1 * | 2/2015 | Lu | F21S 10/046 40/428 |
| 2016/0258585 | A1 | 9/2016 | Gallo et al. | |
| 2017/0167678 | A1 | 6/2017 | Gallo et al. | |

FOREIGN PATENT DOCUMENTS

| | | | | |
|---|---|---|---|---|
| GB | 1164143 | | 9/1969 | |
| GB | 1164144 | * | 9/1969 | F21S 10/04 |
| GB | 1298455 | | 12/1972 | |
| GB | 2180927 | A | 4/1987 | |
| GB | 2230335 | A | 10/1990 | |
| GB | 2298073 | A | 8/1996 | |
| GB | 2315543 | A | 2/1998 | |
| GB | 2372807 | A | 9/2002 | |
| GB | 2402469 | A | 12/2004 | |
| GB | 2489384 | A | 9/2012 | |
| GB | 2509007 | A | 6/2014 | |
| WO | WO2004027321 | A1 | 4/2004 | |
| WO | WO2005078350 | A1 | 8/2005 | |
| WO | WO2006040167 | A2 | 4/2006 | |
| WO | WO2008149117 | A2 | 12/2008 | |

* cited by examiner

FLAME SIMULATING ASSEMBLY

FIELD OF THE INVENTION

The present invention is a flame simulating assembly for providing images of flames and simulated glowing embers in which one or more light sources and a flicker element are positioned at a preselected elevation above a base of the flame simulating assembly.

BACKGROUND OF THE INVENTION

Various electric fireplaces are known, providing flame simulation effects with varying degrees of success. In many, the electric fireplace includes a screen with front or rear surfaces that are formed or treated so that, across their entire areas, light that is directed therethrough is diffused. Typically, light is directed onto the rear surface of the screen to provide images of flames. The prior art electric fireplace imposes certain limits on the possible arrangements of the elements thereof. The flame simulation effects provided by the typical electric fireplace may tend to be somewhat unconvincing, depending on the observer's perspective.

SUMMARY OF THE INVENTION

There is a need for a flame simulating assembly that overcomes or mitigates one or more of the disadvantages or defects of the prior art. Such disadvantages or defects are not necessarily included in those described above.

In its broad aspect, the invention provides a flame simulating assembly including one or more light sources for producing light, a screen to which the light from the light source(s) is directed, to provide a number of images of flames thereon viewable via a front surface of the screen, and a rotatable flicker element. The flicker element includes an elongate rod defined by an axis thereof about which the rod is rotatable, the rod being positioned at a preselected elevation above a base of the flame simulating assembly. The flicker element also includes a number of paddle elements located in respective predetermined locations on the rod, for intermittently reflecting the light from the light source(s) from the paddle elements to the screen respectively as the flicker element rotates about the axis, to provide the images of flames on the screen. The light sources are located substantially at the preselected elevation and proximal to the flicker element.

In another of its aspects, the invention provides a method of providing images of flames. The method includes providing one or more light sources for producing light, and providing a rotatable flicker element. The flicker element also includes an elongate rod defined by an axis thereof, the rod being positionable to locate the axis at a preselected elevation above a base of the flame simulating assembly, and a number of paddle elements located in respective locations on the rod. A screen is provided for displaying a number of images of flames in one or more predetermined regions thereof. A holding bracket is provided for locating the light source(s) t the preselected elevation. The flicker element is rotated about the axis thereof. The light sources are energized. The light from the light sources is at least partially directed to the predetermined region(s), to provide the images of flames therein.

BRIEF DESCRIPTION OF THE DRAWINGS

The invention will be better understood with reference to the attached drawings, in which.

DETAILED DESCRIPTION

Figure 1A:
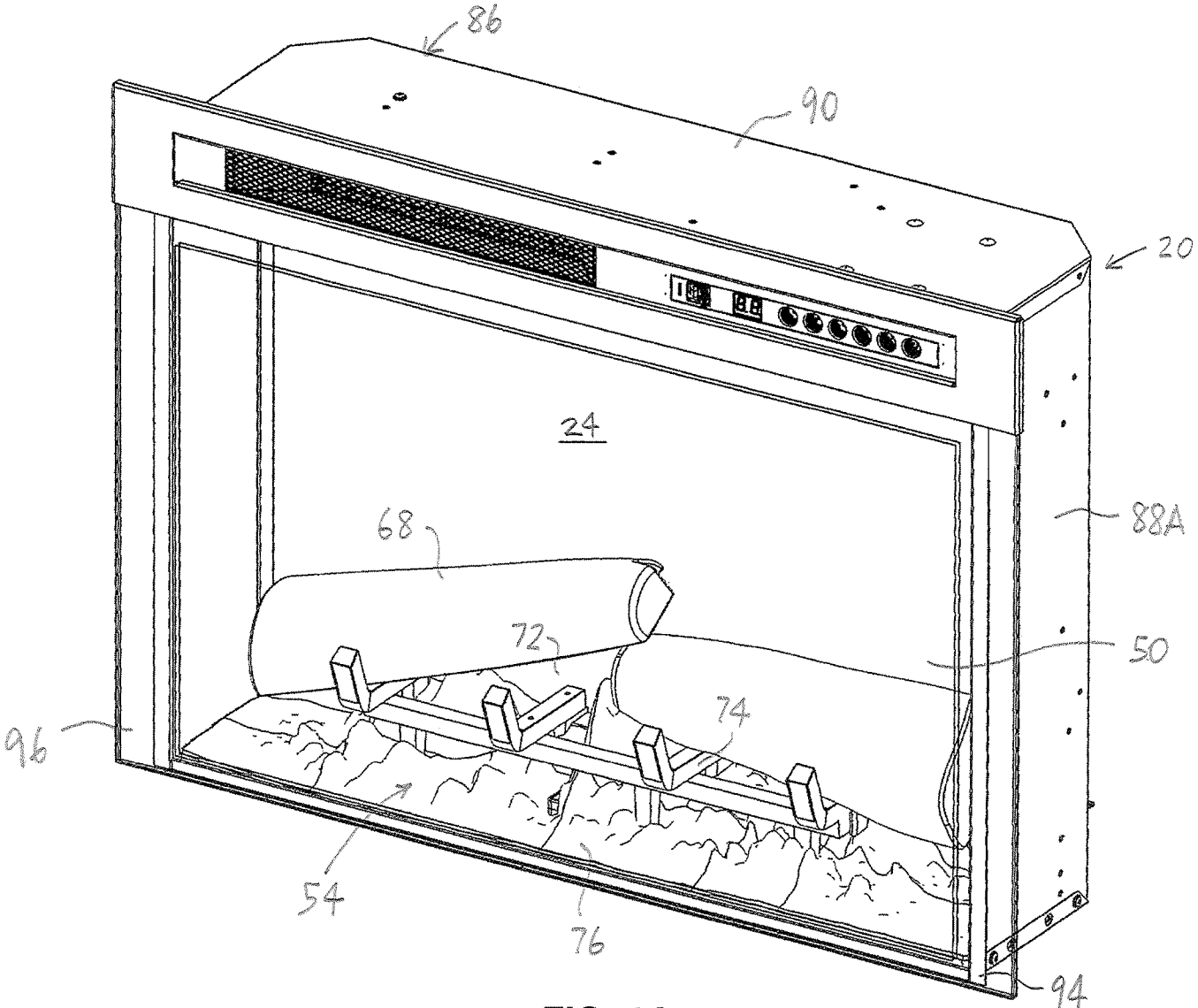
FIG. 1A is an isometric view of an embodiment of the flame simulating assembly of the invention.
Figure 1B:
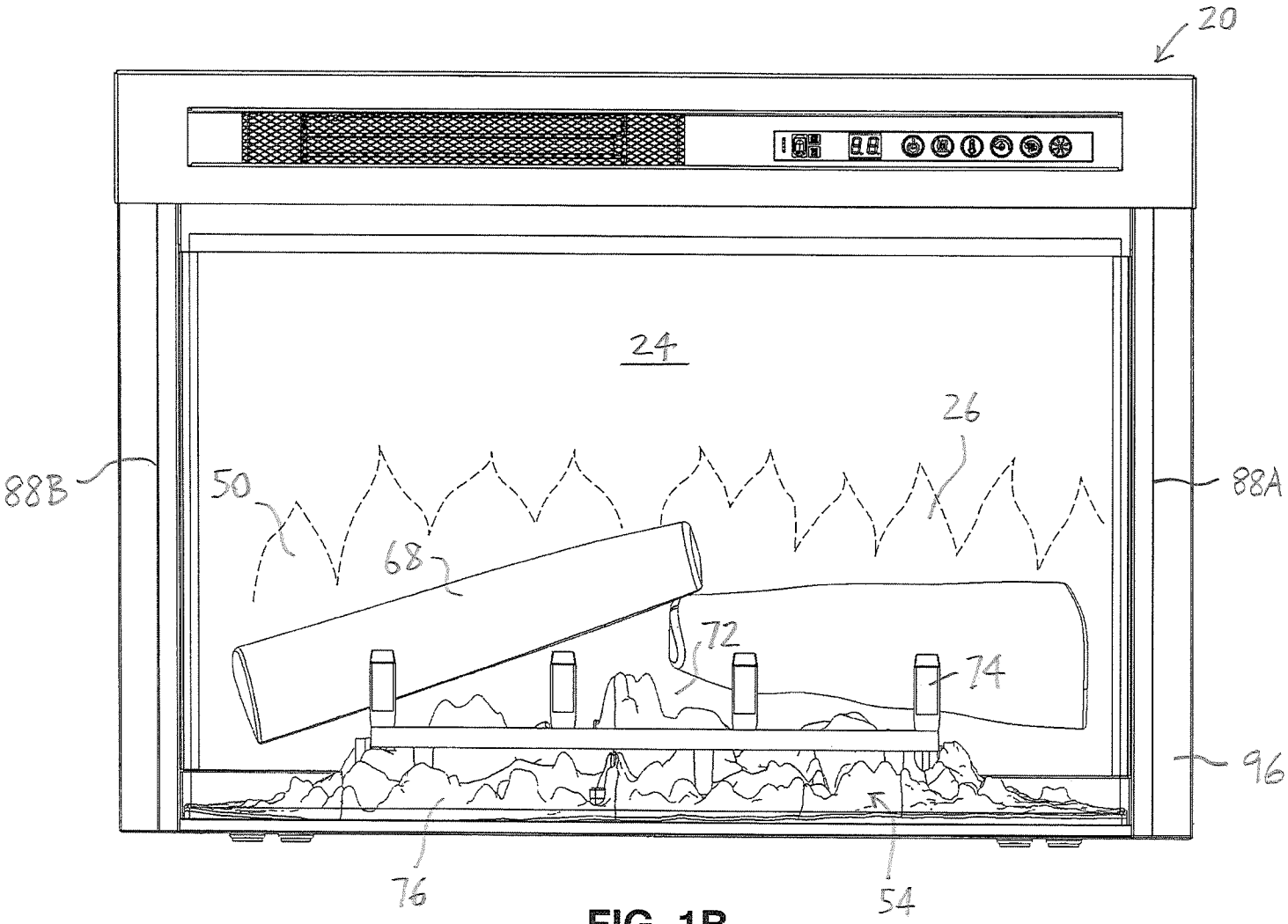
FIG. 1B is a front view of the flame simulating assembly of FIG. 1A in which images of flames on a screen are illustrated.
Figure 1C:
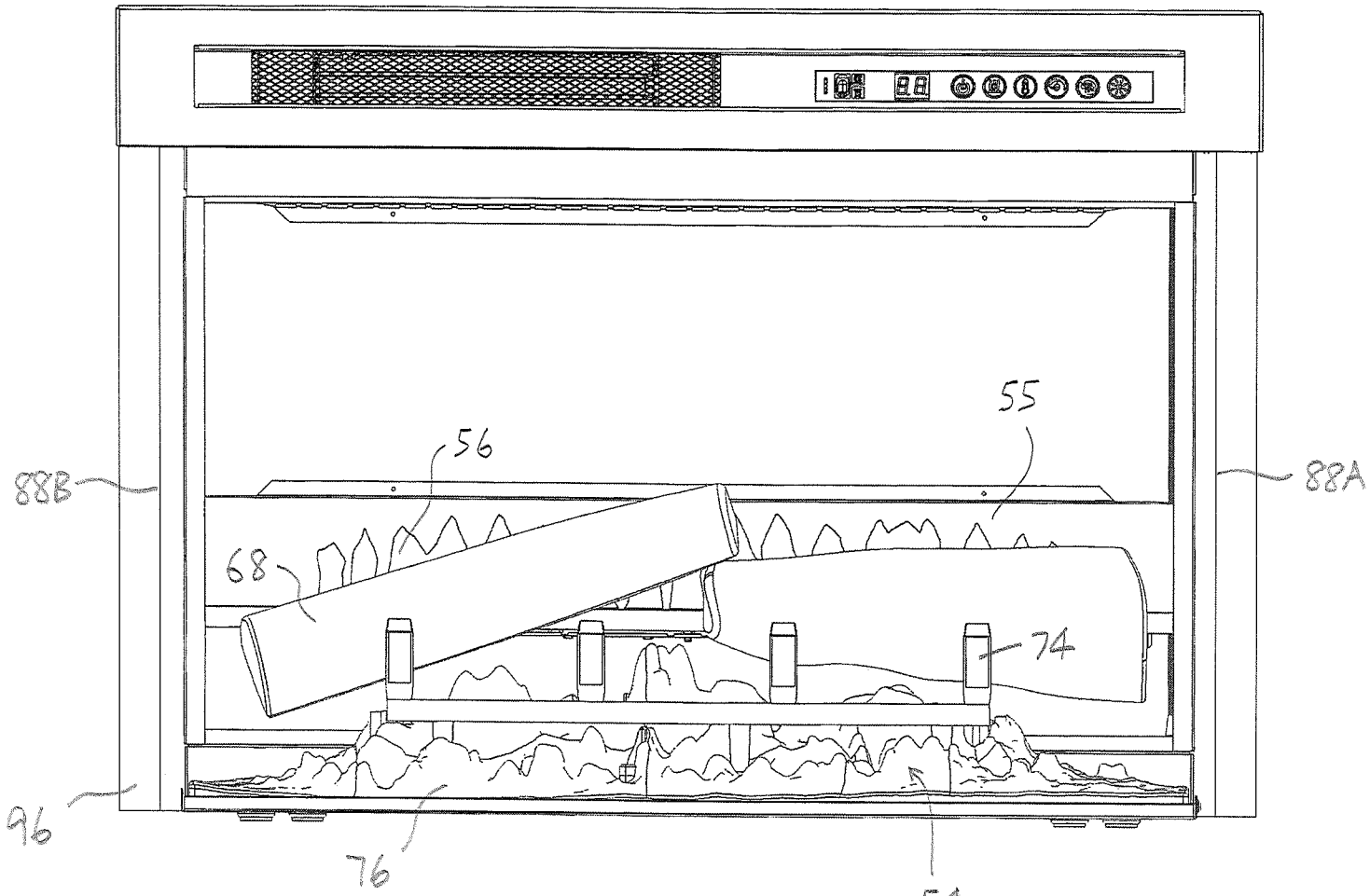
FIG. 1C is another front view of the flame simulating assembly of FIGS. 1A and 1B with the screen thereof omitted.
Figure 2A:
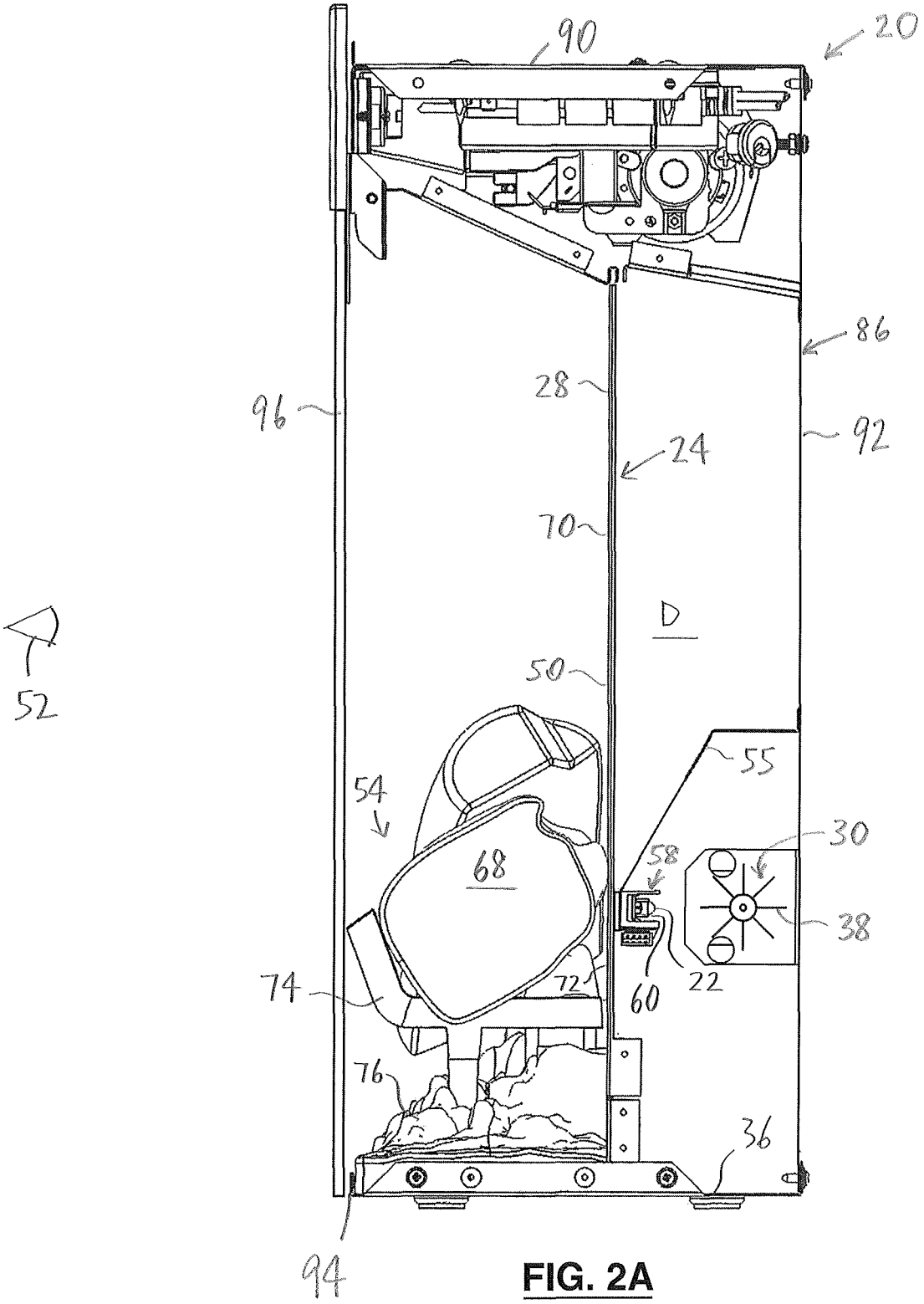
FIG. 2A is a side view, partially cut away, of the flame simulating assembly of FIGS. 1A and 1B.
Figure 2B:
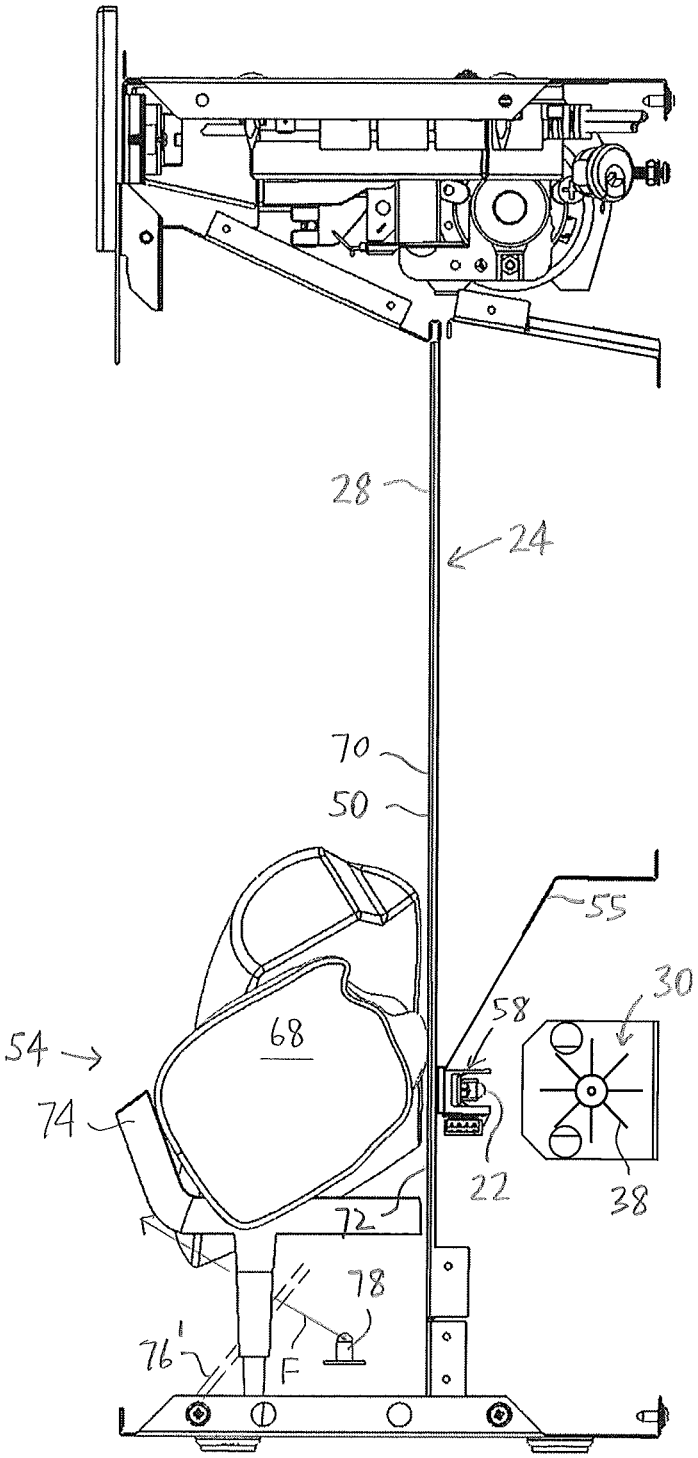
FIG. 2B is another side view of the flame simulating assembly of FIGS. 1A and 1B with certain elements thereof omitted therefrom.
Figure 2C:
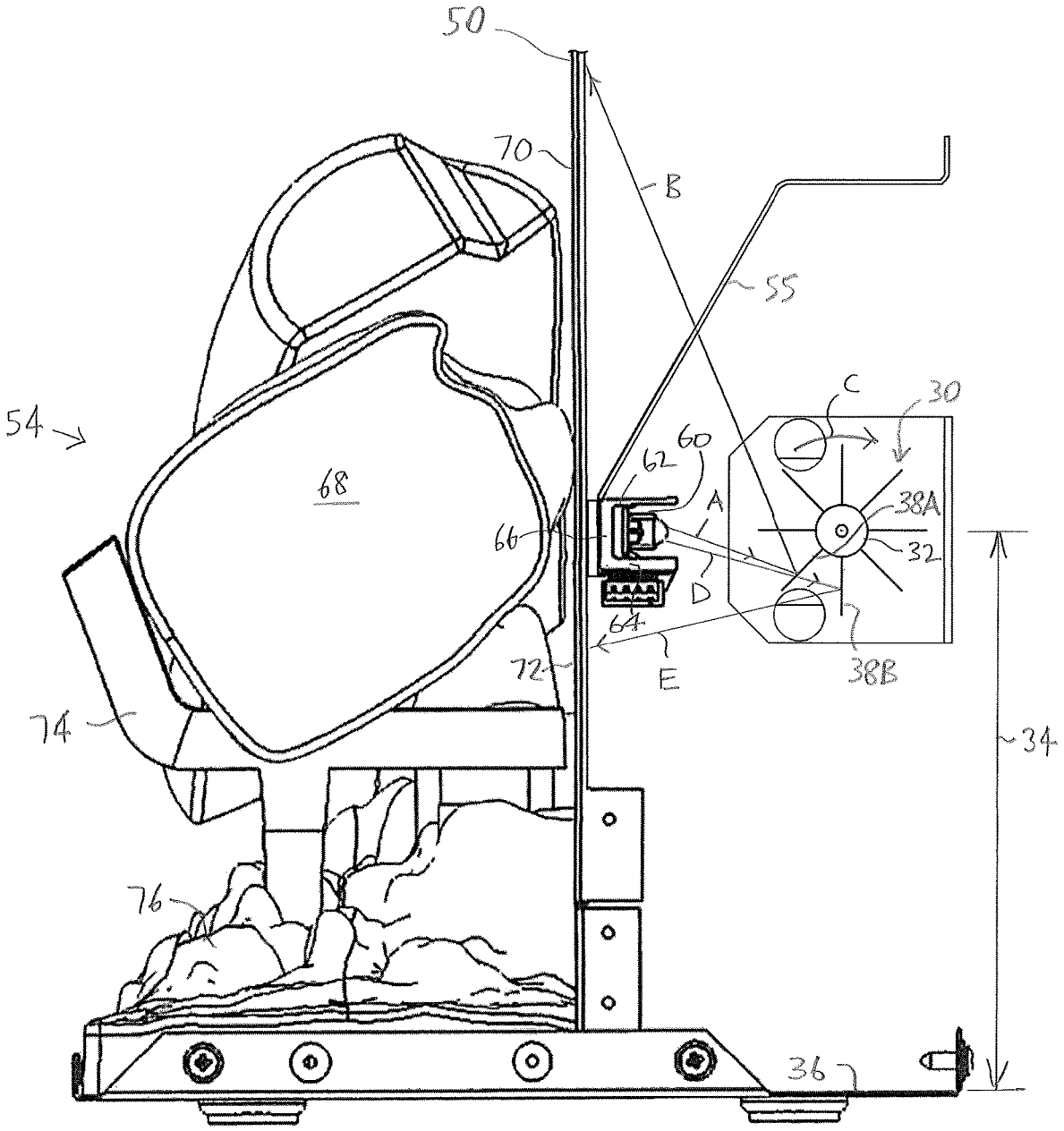
FIG. 2C is a portion of the flame simulating assembly as illustrated in FIG. 2A, drawn at a larger scale.
Figure 3A:
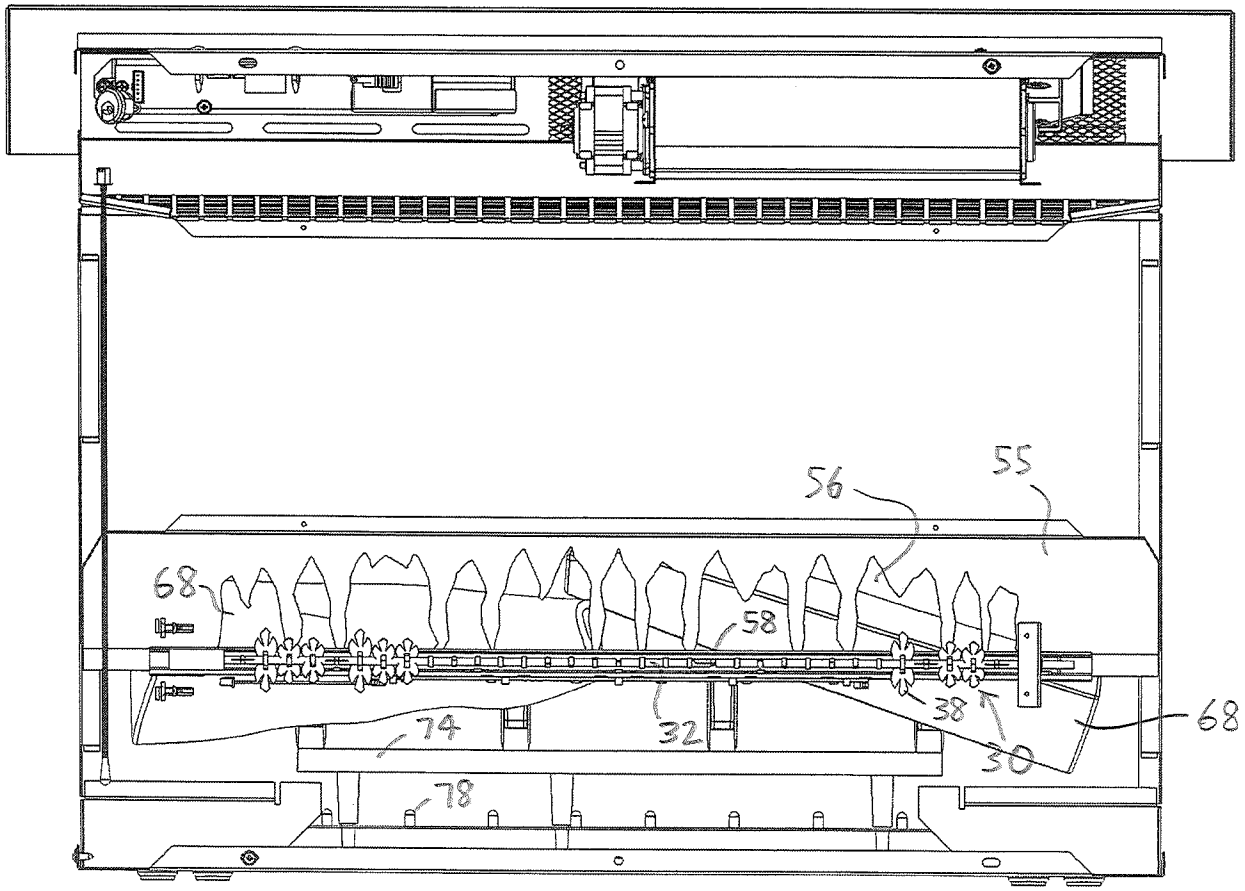
FIG. 3A is a rear view, partially cut away, of the flame simulating assembly of FIGS. 1A and 1B, drawn at a smaller scale.
Figure 3B:
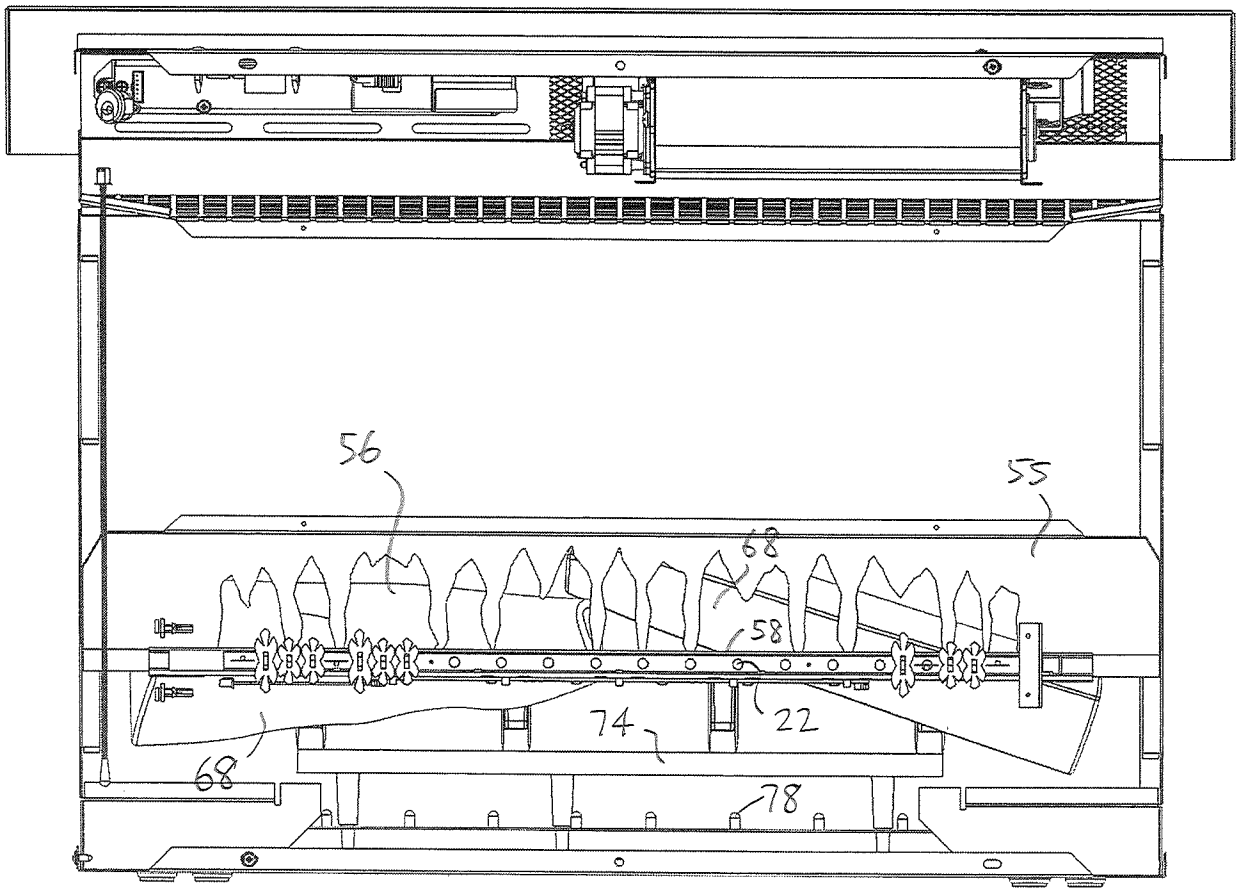
FIG. 3B is another rear view of the flame simulating assembly of FIGS. 1A and 1B with certain elements omitted therefrom.
Figure 4A:
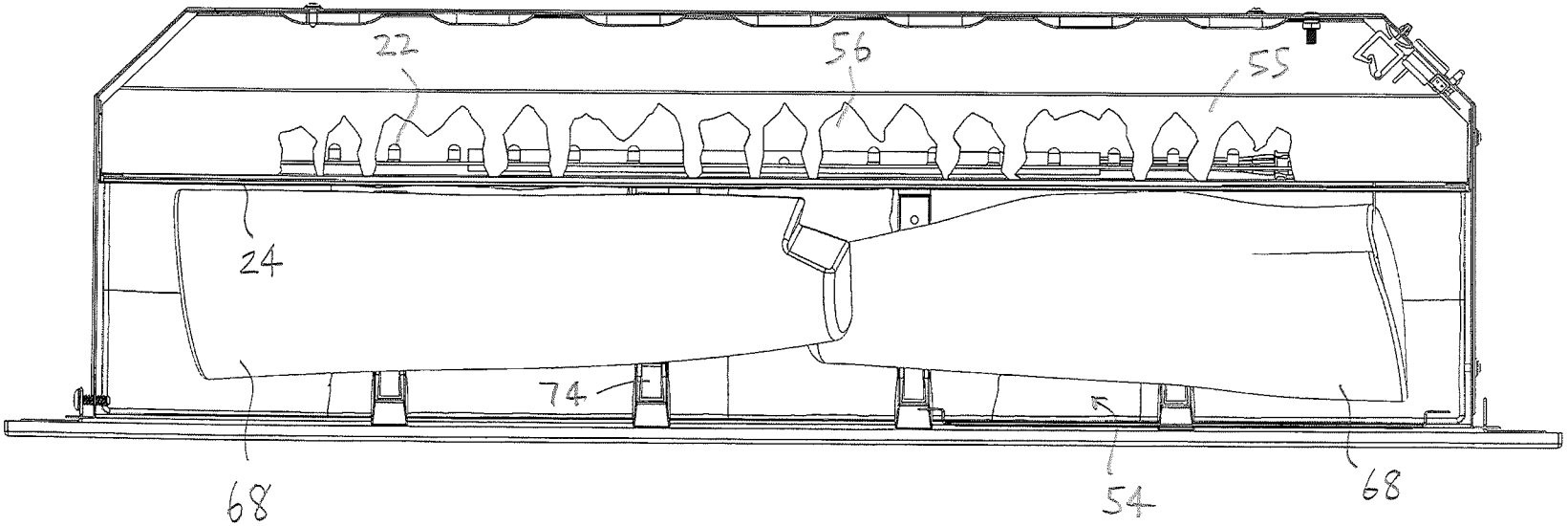
FIG. 4A is a top view of the flame simulating assembly of FIGS. 1A and 1B in which a flame effect element is shown.

In the attached drawings, like reference numerals designate corresponding elements throughout. Reference is made to FIGS. 1A-5 to describe an embodiment of a flame simulating assembly in accordance with the invention indicated generally by the numeral 20. In one embodiment, the flame simulating assembly 20 preferably includes one or more light sources 22 (FIGS. 2A, 2B) for producing light, a screen 24 (FIGS. 1A, 1B, 2A, 2B) to which the light from the light source 22 is directed, to provide a number of images 26 of flickering flames thereon (FIG. 1B) viewable via a front surface 28 of the screen 24, and a rotatable flicker element 30 (FIGS. 2A-2C). Preferably, the flicker element 30 includes an elongate rod 32 defined by an axis 33 thereof about which the rod 32 is rotatable (FIG. 5). The rod 32 preferably is positioned at a preselected elevation 34 above a base 36 (FIG. 2C) of the flame simulating assembly 20, as will be described. As illustrated in FIG. 5, it is also preferred that the flicker element 30 includes a number of paddle elements 38 located in respective locations on the rod 32. In one embodiment, the paddle elements 38 preferably are located in the respective locations therefor for intermittently reflecting the light from the light source 22 from the paddle elements 38 to the screen 24 as the flicker element 30 rotates about the axis 33, to provide the images 26 of flickering flames on the screen 24. As will also be described, the light source 22 preferably is located substantially at the preselected elevation 34 and proximal to the flicker element 30.

As will also be described, the images 26 of flames preferably are provided at one or more predetermined regions 50 on the screen 24 (FIGS. 1A, 1B, and 2A-2C). As can be seen in FIG. 2C, it is preferred that the predetermined region 50 is located above the preselected elevation 34. Because of the positioning of the images of flames on the screen 24, from the point of view of an observer 52 (FIG. 2A), the images 26 of flames appear to be arising from a trim subassembly 54 that is positioned in front of the screen 24 (FIGS. 1A, 1B, 2A-2C). As will be described, the trim subassembly 54 preferably is formed and positioned to enhance the simulation of a fire by the flame simulating assembly 20.

Preferably, the light from the light source 22 is reflected toward the screen 24 from the flicker element 30, i.e., by the paddle elements 38 intermittently, to provide the images 26 of the flickering flames. In FIG. 2C, the light from the light source 22 is schematically represented by arrow "A". The light from the light source 22 that is reflected by a selected one of the paddle elements 38 (identified for convenience by reference numeral 38A) is schematically represented by arrow "B". The rod 32 of the flicker element 30 is rotated about its axis 33, in the direction indicated by arrow "C". As described above, the paddle elements 38 that are mounted to the rod are secured to the rod, and rotate with the rod.

It will be understood that, in one embodiment, the respective locations of paddle elements 38 on the rod 32 are predetermined, e.g., each paddle element 38 may be located in a position radially offset from the paddle element(s) immediately proximal to it on the rod. Also, the predetermined locations may be spaced apart from each other along the rod 32 at predetermined intervals. For example, the paddle elements may be spaced apart at substantially equal distances from each other along the rod. Alternatively, however, the locations of the paddle elements on the rod may be random, i.e., either or both the radial positioning and the axial (lengthwise) positioning of the paddle elements relative to the other paddle element(s) proximal thereto may be random.

As can be seen in FIGS. 2B and 2C, the light from the light source 22 (schematically represented by the arrows "A" and "B") is reflected toward the screen 24 by each of the paddle elements in turn, as the rod is rotated about its axis 33. The light preferably is reflected from each paddle element, as each paddle element is moved in turn to locations where such reflection may occur, toward one or more of the predetermined regions 50 on the screen 24. Because the light from the light source is reflected from the paddle elements 38 in turn as the rod is rotated, the reflection of the light from the flicker element 30 toward the screen 24 is intermittent. The intermittent or flickering intensity of the light that is reflected toward the screen results in a realistic simulation of a fire.

Figure 4B:
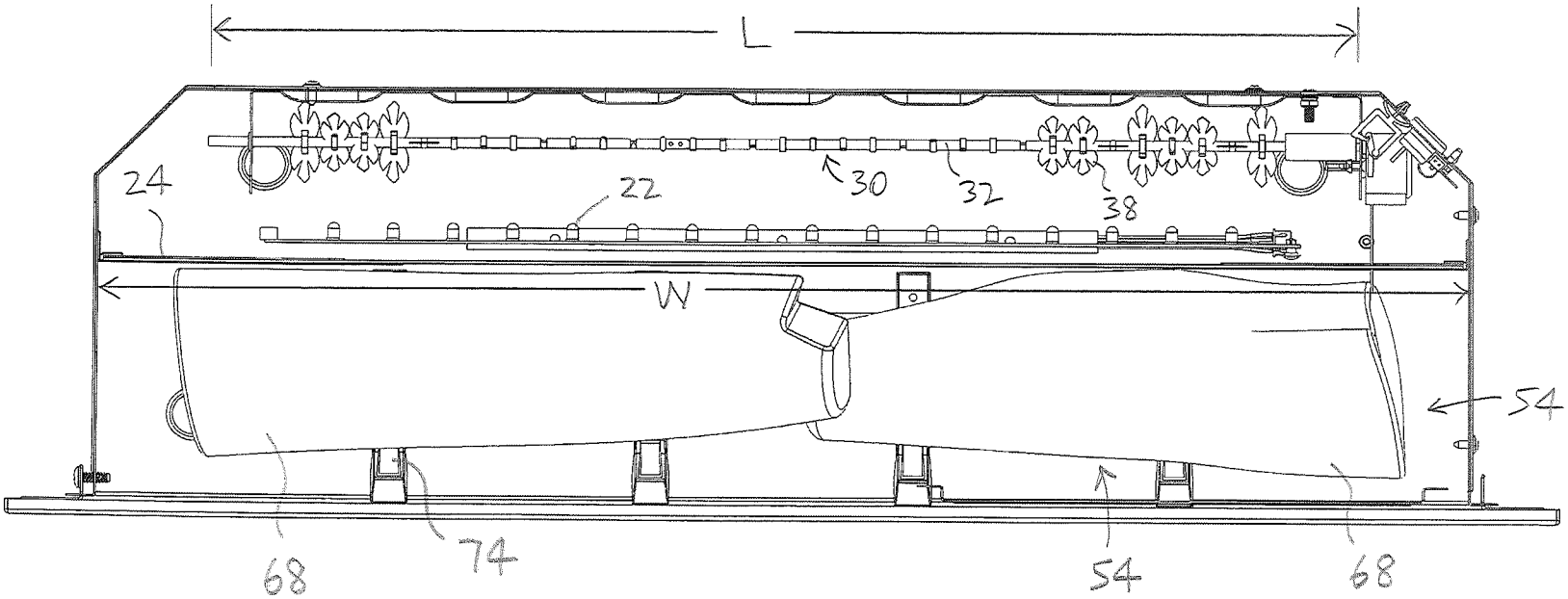
FIG. 4B is another top view of the flame simulating assembly of FIGS. 1A and 1B with the flame effect element omitted therefrom.
Figure 5:
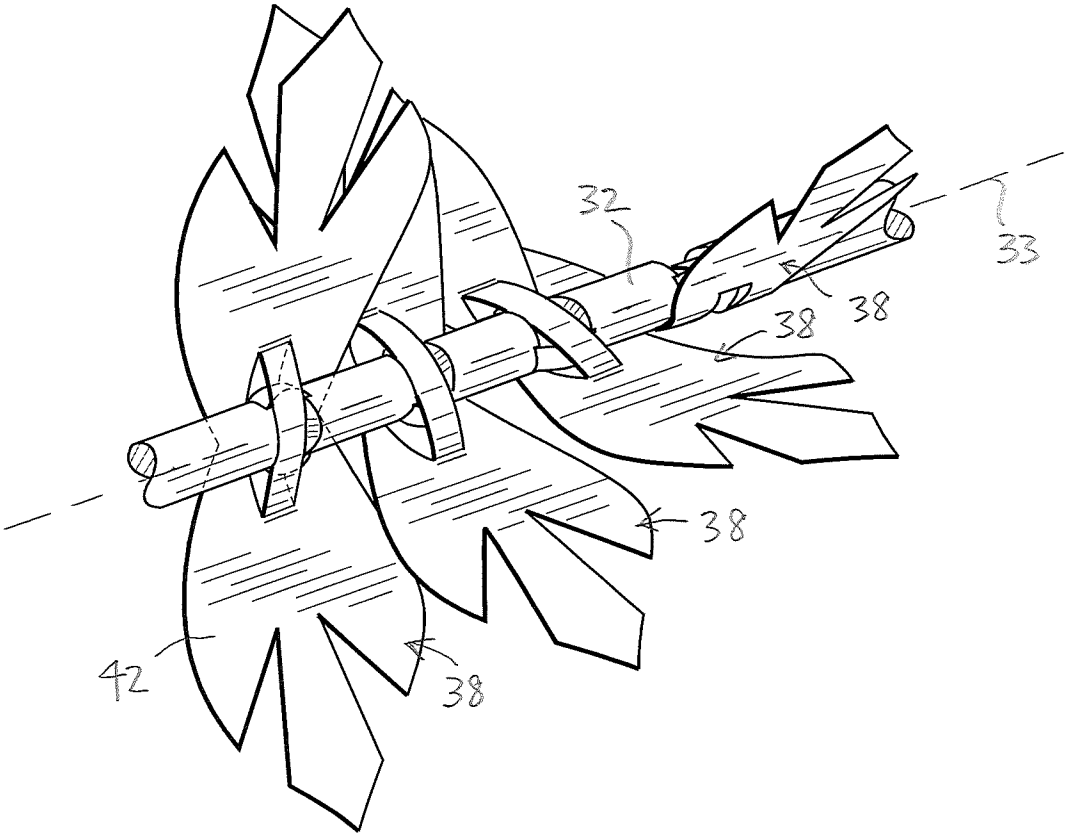
FIG. 5 is an isometric view of a portion of an embodiment of a flicker element of the invention including paddle elements mounted on a rod, drawn at a larger scale.

As can be seen in FIG. 4B, it is preferred that the flicker element 30 is located substantially parallel to the screen 24. Preferably, and as shown in FIG. 4B, the flicker element 30 has a length "L" that is less than the width "W" of the screen 24. It will be understood that a number of paddle elements 38 are omitted from FIGS. 3A, 3B, and 4B for clarity of illustration. From the foregoing, it will be understood that the light from the light source 22 is reflected toward the screen 24 intermittently from the flicker element 30 along its length, as the flicker element 30 is rotated.

In one embodiment, and as can be seen in FIGS. 1C and 2A-2C, the flame simulating assembly 20 preferably also includes a flame effect element 55 for configuring the light from the light source 22 that is reflected from the flicker element 30 toward the predetermined region(s) 50 to provide the images 26 of flames therein. It is also preferred that the flame effect element 55 includes apertures 56 therein that are generally shaped to provide the images 26 of flames, when the light from the light source 22 is directed therethrough. As can be seen in FIGS. 1C and 3A-4A, the flame effect element 55 preferably extends across almost the width of the screen 24.

As can be seen in FIGS. 2B and 2C, the flame effect element 55 preferably is located in a path of the light reflected from the flicker element toward the predetermined region(s) 50. As noted above, the light from the light source 22 is reflected intermittently from the flicker element 30. Because of this, the light that is transmitted through the apertures 56 of the flame effect element 55 to the predetermined regions 50 provides the images 26 of flames that flicker, or fluctuate in intensity. The flickering or fluctuating of the images 26 of flames enhances the simulation thereby of the flames of a fire.

Preferably, the screen 24 is formed so that the light from the light source 22 that is transmitted therethrough is subjected to diffusion, as is known in the art. Those skilled in the art would be aware of suitable screens and materials thereof, and methods for forming suitable screens. The diffusing screen 24 tends to obscure the elements located behind the screen 24 (e.g., the flame effect element 55, and the flicker element 30), so that such elements are generally not observable, or at least not easily observable, by the observer 52.

As can be seen in FIGS. 2A-2C, it is also preferred that the light source 22 is located at the preselected elevation 34 above the base 36 of the flame simulating assembly 20, which is at substantially the same height above the base as the height at which the rod 32 is located. This positioning of the light source 22 and the rod 32 provides relatively realistic images 26 of the flames.

Preferably, the flame simulating assembly 20 includes a holding bracket 58 for locating the light source 22 at the preselected elevation 34. It is also preferred that the holding bracket 58 at least partially directs the light from the light source 22 toward the flicker element 30.

As can be seen in FIGS. 3A and 3B, the holding bracket preferably extends along the length "L" of the flicker element 30. It will be understood that the rod 32 is omitted from FIG. 3B for clarity of illustration.

Those skilled in the art would appreciate that the holding bracket 58 may have any suitable configuration. In one embodiment, the holding bracket 58 preferably is a rigid elongate piece of a suitable material defining a channel 60 in which the light source 22 is located. It is preferred that the holding bracket 58 is positioned substantially at the preselected elevation 34. In one embodiment, the light source 22 preferably includes a number of light-emitting diodes (LEDs) that are spaced apart from each other and located in respective sockets therefor (not shown) positioned along a length of the holding bracket 58 (FIG. 3B). In FIG. 4A, the holding bracket 58 is omitted in order to show the location of the light sources 22 relative to the flame effect element 55 and the screen 24. In FIG. 4B, the flame effect element 55 has been omitted in order to show the location of the light sources 22 relative to the flicker element 30 and the screen 24, in a top view.

The channel 60 preferably is defined by a back part 62 and top and bottom parts 64, 66 of the holding bracket 58 (FIG. 2C). As can be seen in FIG. 2C, because the light source 22 is located in the channel 60, the light source 22 is shielded somewhat by the bracket 58. The light therefrom is prevented by the back part 62 and the top and bottom parts 64, 66 from being directed other than generally toward the flicker element 30.

It will be understood that the trim subassembly 54 may be provided in different forms. For example, in one embodiment, the trim subassembly 54 preferably includes one or more simulated fuel elements 68 (FIGS. 1A-2C). In one embodiment, the simulated fuel elements 68 preferably are at least partially positioned at the preselected elevation 34, to at least partially conceal the holding bracket 58 (FIG. 2C). It is also preferred that the simulated fuel elements 68 are located proximal to a front surface 70 of the screen 24 (FIGS. 2A-2C). Those skilled in the art would appreciate that the simulated fuel elements 68 may be provided in any suitable form. For example, as illustrated in FIGS. 1A-2C, the simulated fuel elements 68 are simulations of wooden logs. However, those skilled in the art would appreciate that the simulated fuel elements 68 may be any suitable objects, or formed to resemble any suitable objects, e.g., pieces of coal. Alternatively, for example, the fuel elements 68 may be actual wooden logs.

Preferably, the trim subassembly 54 includes a grate element 74, for supporting the simulated fuel elements 68. Also, the trim subassembly 54 preferably includes a simulated ember bed 76 positioned at least partially below the simulated fuel element(s) 68 (FIGS. 1A-2A and 2C). In one embodiment, the simulated ember bed 76 preferably is formed to resemble a bed of embers, e.g., such as would result from burning wooden logs for a period of time. Alternatively, the simulated ember bed 76 may be provided in any suitable configuration.

Those skilled in the art would be aware of suitable materials and methods of forming the simulated fuel elements 68, the grate element 74, and the simulated ember bed 76.

As noted above, the trim subassembly 54 may, alternatively, be provided in other forms, which may or may not include simulations of combustible fuel. For instance, the trim subassembly 54 may be a media bed arrangement (not shown) that is formed and positioned to at least partially conceal the holding bracket 58. The media bed arrangement of the trim subassembly 54 may include, for example, appropriately sized and colored pieces of crushed glass, or acrylic. For the purposes of description herein, the trim subassembly 54 is an exemplary simulated fuel bed.

It will be understood that not all of the light from the light source 22 that is reflected by the flicker element 30 is directed toward the predetermined region(s) 50. In one embodiment, it is preferred that the light from the light source 22 that is reflected from the flicker element 30 toward the screen 24 at least partially bypasses the flame effect element 55 to provide a glowing ember effect in one or more lower regions 72 of the screen 24 that are positioned below the preselected elevation 34 (FIG. 2C). Preferably, and as can be seen in FIGS. 1A and 1B, the lower region 72 is observable at least partially below the simulated fuel element(s) 68.

As can be seen in FIGS. 1A, 1B, and 2A-2C, the lower regions 72 preferably are at least partially viewable by the observer 52. The lower regions 72 on the screen preferably are located generally below the simulated fuel elements 68. The lower regions 72 may also be viewable between the simulated fuel elements 68, depending on the shapes and the positioning of the simulated fuel elements 68.

Where the trim subassembly 54 does not include simulated fuel elements, the light directed to the lower regions 72 provides a glowing effect that can be viewed through the trim subassembly 54.

As can be seen in FIG. 2C, the light from the light source 22 that is reflected by the flicker element 30 to the lower regions 72 is unaffected by the flame effect element 55. As illustrated in FIG. 2C, certain of the light from the light source 22 is directed to a paddle element identified for convenience as 38B that is positioned to reflect at least part of the light directed thereto toward the lower regions 72 of the screen 24. The light from the light source is schematically represented by arrow "D" in FIG. 2C, and the light reflected from the paddle element 38B toward the lower regions 72 is schematically represented by arrow "E". As described above, due to the rotation of the rod 32 about its axis 33, the light from the light source 22 is reflected from the paddle element 38B, and also from other paddle elements positioned for such reflection in turn, intermittently, so that the reflected light directed to the lower regions 72 appears to pulse (i.e., to vary in intensity) at irregular intervals, thereby simulating irregularly pulsating, glowing embers.

The light reflected from the flicker element 30 that is directed to the lower regions 72 therefore provides a realistic pulsating glowing light of varying intensity in the lower regions 72. As noted above, the lower regions 72 are below and/or between or beside the simulated fuel elements 68. Accordingly, the light that is reflected to the lower regions 72 provides a realistic simulation of the glowing light in the heart or central region of a fire, i.e., a glowing effect.

The realistic simulation of flames appear to be due, at least in part, to the location of the light source 22 at substantially the same elevation as the rod 32 of the flicker element 30. It is believed that this has resulted in more realistic images 26 of the flickering flames for the following reasons.

(a) The light source 22 is located proximal to the flicker element 30. Because of this, at least some of the light from the light source 22 that is reflected from the paddle elements 38 to the predetermined regions 50 of the screen 24 (via the flame effect element 55) is relatively intense, notwithstanding that the light has been reflected from the paddle element(s) 38. Due to the intermittent nature of the relatively intense reflected light, the images of flames resulting therefrom are relatively realistic, with a flickering aspect that is realistic.

(b) As described above, some of the light that is reflected from the flicker element 30 is directed to the lower regions 72 of the screen 24.

Accordingly, the observer 52 may view the light from the light source 22 that is reflected from the flicker element 30 and that has bypassed the flame effect element 55. Because such light is reflected from the flicker element 30, it also fluctuates in intensity, resembling the variations in intensity of light emanating from embers in a fire. This reflected light is also relatively intense. Because the light that reaches the lower regions 72 has not been formed into images of flames, a realistic pulsating, glowing ember effect is provided in the lower regions 72.

In one embodiment, the flame simulating assembly 20 preferably also includes one or more ember bed light sources 78 (FIG. 2B) positioned to direct ember bed light therefrom inside the simulated ember bed 76, to simulate glowing embers in the simulated ember bed. The ember bed light source 78 preferably is controlled so that the ember bed light produced thereby fluctuates, or pulsates, to provide a glowing light effect similar to light from glowing embers in a wood fire. In one embodiment, the ember bed light source 78 preferably provides the ember bed light pulsating at a frequency that is different from the frequency at which the light from the light source 22 that fluctuates due to its reflection from the flicker element 30.

Preferably, the simulated ember bed 76 is formed of a suitable translucent material (or translucent and transparent material, or translucent material with holes or gaps therein) that is formed to provide a realistic ember glow, when the ember bed light from the ember bed light source is directed therethrough, from inside the simulated ember bed 76. At least some of the ember bed light that is transmitted through the simulated ember bed 76 is subjected to diffusion. Those skilled in the art would be aware of suitable materials that may be used to provide a suitable simulated ember bed.

It will be understood that the simulated ember bed 76 is omitted from FIGS. 2B, 3A, and 3B for clarity of illustration. In FIG. 2B, a portion of the simulated ember bed is shown, identified for convenience by reference numeral 76'. As can be seen in FIGS. 2A and 2B, in one embodiment, the ember bed light source 78 preferably is located inside the simulated ember bed 76. As illustrated in FIGS. 1A-1C, the simulated ember bed 76 preferably extends substantially along the width "W" of the screen 24. It is also preferred that the ember bed light 78 includes a number of LEDs that are positioned at intervals along the length of the simulated ember bed 76 (FIGS. 3A, 3B). When the ember bed light source 78 is energized, the ember bed light therefrom is directed through the simulated ember bed 76. In FIG. 2B, the ember bed light from the ember bed light source 78 is schematically represented by arrow "F".

Those skilled in the art would appreciate that the flicker element 30 may have any suitable configuration, and the paddle elements 38 may have any suitable form.

Each of the paddle elements 38 includes one or more body portions 40 having one or more reflective surfaces 42 thereon. As will be described, the reflective surface 42 preferably includes a central region 44 and a perimeter region 46 at least partially located around the central region 44, the perimeter region 46 at least partially defining a perimeter plane 48. Preferably, the paddle elements 38 are located in the respective locations therefor to position the perimeter plane 48 substantially perpendicular to the axis 33, for intermittently reflecting the light from the light source 22 therefrom as the rod 32 is rotated. The central region 44 preferably is substantially non-planar and the perimeter region preferably is at least partially planar, to cause the light from the light source 22 reflected therefrom to the screen 24 as the flicker element 30 rotates to have varying intensity, at the predetermined region(s) 50 on the screen 24.

Figure 6A:
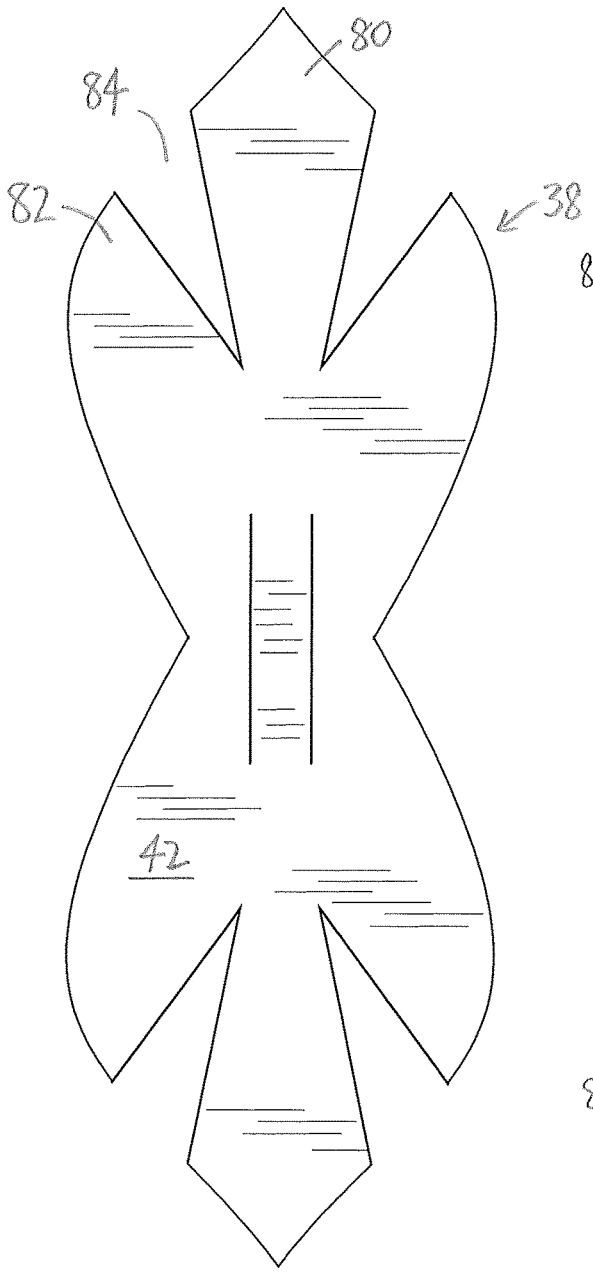
FIG. 6A is a top view of an embodiment of the paddle element of the invention, drawn at a larger scale.

The paddle elements 38 are described in more detail in U.S. patent application Ser. No. 15/444,994, filed on Feb. 28, 2017, the entirety of which application is hereby incorporated herein by reference. As can be seen in FIG. 6A, the perimeter region 46 preferably includes one or more middle parts 80 and one or more side parts 82. The middle part 80 preferably is at least partially defined by one or more channels 84 partially separating the middle part 80 and the side part(s) 82.

Figure 6B:
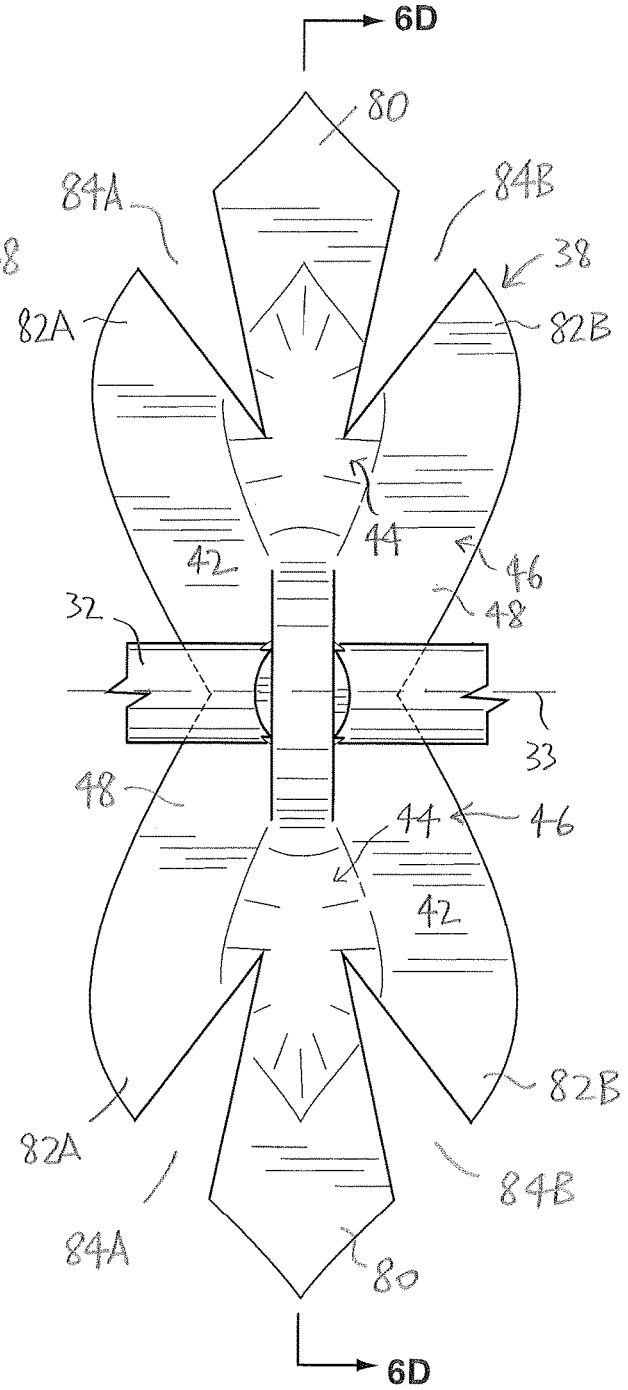
FIG. 6B is a top view of the paddle element of FIG. 6A when mounted on the rod in the flicker element of FIG. 5.
Figure 6C:
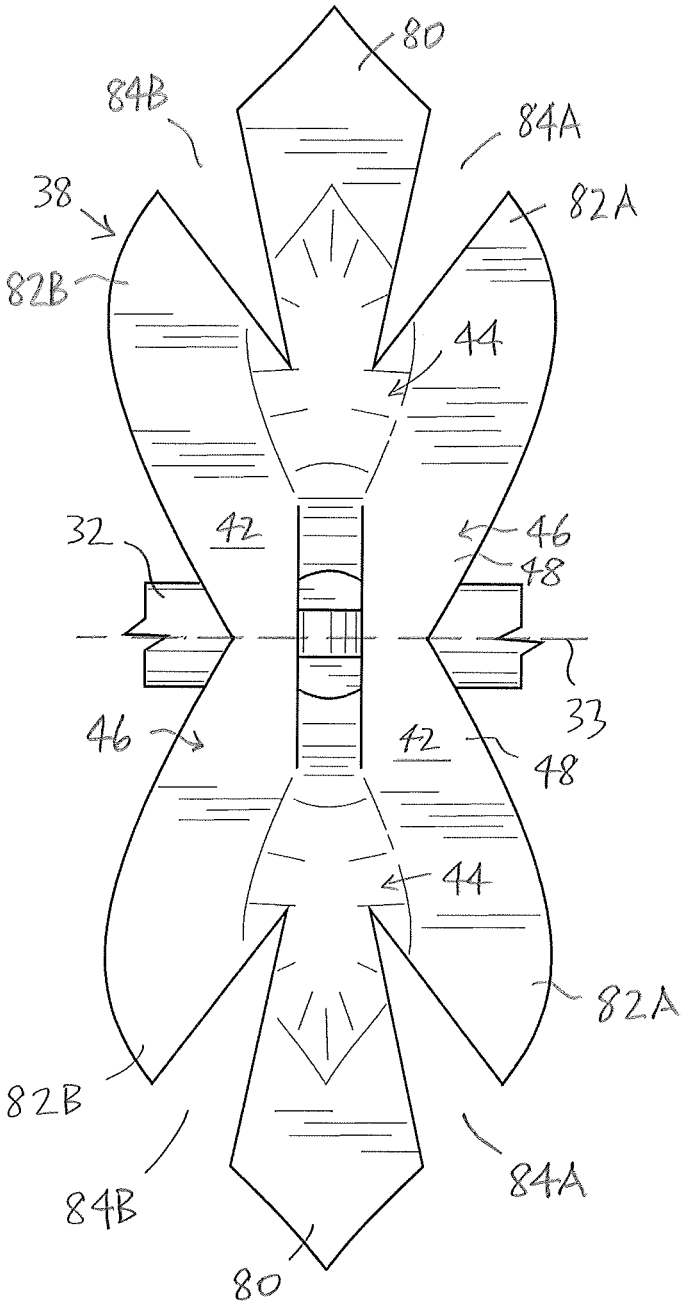
FIG. 6C is a back view of the paddle element and the rod of FIG. 6A.

In FIGS. 6B and 6C, the paddle element 38 is illustrated mounted on the rod. In one embodiment, it is preferred that there are two side parts, identified for convenience as a first side part 82A and a second side part 82B (FIGS. 6B, 6C). Also, it is preferred that there are first and second channels, identified for convenience by reference numerals 84A, 84B in FIGS. 6B and 6C. As can be seen in FIGS. 6B and 6C, the middle part 80 is at least partially defined by the first and second channels 84A, 84B. The first channel 84A preferably is located between the middle part 80 and the first side part 82A, and the second channel 84B preferably is located between the middle part 80 and the second side part 82B.

Alternative embodiments of the paddle elements are described in U.S. patent application Ser. No. 14/845,527, filed on Sep. 4, 2015, the entirety of which application is also hereby incorporated by reference.

In one embodiment, the flame simulating assembly 20 preferably includes a box subassembly 86 defining a cavity "D" therein (FIG. 2A) in which the light source 22, the screen 24, the flicker element 30, the simulated fuel bed 54, and certain other elements thereof are located. The box subassembly 86 preferably includes sidewalls 88A, 88B, a top wall 90, a back wall 92, and the base 36. As can be seen in FIGS. 1A and 2A, the box subassembly 86 preferably is open at a front side 94 thereof. It is also preferred that the flame simulating assembly 20 includes a front panel 96, secured to the front side 94 of the box subassembly 86, that is at least partially transparent and/or translucent, so that the screen 24 and the simulated fuel bed 54 are viewable through the panel 96 by the observer 52 (FIG. 2A). The panel 96 may include one or more opaque or semi-opaque regions (not shown) located to obscure, from the observer's point of view, structural or other features of the box subassembly 20 or other elements. For instance, an area around the perimeter of the panel 96 (or part thereof) may be treated so that the front edges of the sidewalls 88A, 88B, and brackets holding the panel 96 in position are not viewable by the observer 52.

In use, a method of the invention preferably includes providing the holding bracket 58 for locating the light source(s) 22 at the preselected elevation 34. The flicker element is rotated about the axis, and the light source is energized. As described above, the light therefrom is at least partially directed to the predetermined region(s) 50, to provide the images 26 of flames therein. The flame effect element 55 preferably is positioned between the flicker element 30 and the predetermined region(s) 50, to configure the light from the light source 22 to form the images 26 of flames.

Preferably, the simulated fuel elements 68 are positioned proximal to the front surface of the screen, for at least partially concealing the holding bracket 58.

It is also preferred that the light from the light source 22 that is reflected from the flicker element 30 toward the screen 24 at least partially bypasses the flame effect element 55, and is directed to the lower region(s) 72, to provide a glowing ember effect therein.

It will be appreciated by those skilled in the art that the invention can take many forms, and that such forms are within the scope of the invention as claimed. The scope of the claims should not be limited by the preferred embodiments set forth in the examples, but should be given the broadest interpretation consistent with the description as a whole.

We claim:

1. A flame simulating assembly for viewing by a viewer positioned in front of the flame simulating assembly, the flame simulating assembly comprising:

at least one light source for producing light;

a screen to which the light from said at least one light source is directed, to provide a plurality of images of flames thereon viewable via a front surface of the screen;

at least one trim subassembly, comprising at least one simulated fuel element that is located in front of the screen, and proximal to the front surface of the screen;

a rotatable flicker element located behind the screen, comprising:

an elongate rod defined by an axis thereof about which the rod is rotatable, the rod being positioned at a preselected elevation above a base of the flame simulating assembly and horizontally spaced apart from said at least one simulated fuel element;

a plurality of paddle elements located in respective predetermined locations on the rod, for intermittently reflecting the light from said at least one light source from the paddle elements to the screen respectively as the flicker element rotates about the axis, to provide the images of flames on the screen;

a flame effect element for configuring the light from said at least one light source that is reflected from the flicker element toward at least one predetermined region on the screen located above said at least one simulated fuel element to provide the images of flames therein;

a holding bracket for locating said at least one light source at the preselected elevation and proximal to the flicker element, to provide the images of flames at said at least one predetermined region on the screen;

said at least one trim subassembly being at least partially positioned at the preselected elevation, to at least partially conceal the holding bracket from the viewer; and the flicker element being positioned to reflect a portion of the light from said at least one light source that is reflected toward the screen to at least partially avoid the flame effect element, to provide a glowing effect in at least one lower region of the screen that is positioned below said at least one simulated fuel element.

2. The flame simulating assembly according to claim 1 in which the holding bracket at least partially shields said at least one light source, to direct the light from said at least one light source only toward the flicker element.

3. The flame simulating assembly according to claim 1 in which said at least one trim subassembly additionally comprises at least one simulated ember bed positioned at least partially below said at least one simulated fuel element.

4. The flame simulating assembly according to claim 3 additionally comprising at least one ember bed light source positioned to direct ember bed light therefrom inside said at least one simulated ember bed, to simulate glowing embers in said at least one simulated ember bed.

5. The flame simulating assembly according to claim 1 in which:

each said paddle element comprises at least one body portion having at least one reflective surface thereon, said at least one reflective surface comprising a central region and a perimeter region at least partially located around the central region, the perimeter region at least partially defining a perimeter plane;

the paddle elements being located in the respective locations therefor to position the perimeter plane substantially perpendicular to the axis, for intermittently reflecting the light from said at least one light source therefrom as the rod is rotated; and the central region being substantially non-planar and the perimeter region being at least partially planar, to cause the light reflected therefrom to the screen as the flicker element rotates to have varying intensity on the screen.

6. The flame simulating assembly according to claim 5 in which the perimeter region comprises at least one middle part and at least one side part, said at least one middle part being at least partially defined by at least one channel partially separating said at least one middle part and said at least one side part.

7. A flame simulating assembly comprising:

at least one light source for producing light;

a screen to which the light from said at least one light source is directed, to provide a plurality of images of flames thereon viewable via a front surface of the screen;

a rotatable flicker element comprising:

an elongate rod defined by an axis thereof about which the rod is rotatable, the rod being positioned at a preselected elevation above a base of the flame simulating assembly;

a plurality of paddle elements located in respective predetermined locations on the rod, for intermittently reflecting the light from said at least one light source from the paddle elements to the screen respectively as the flicker element rotates about the axis, to provide the images of flames on the screen;

said at least one light source being located substantially at the preselected elevation and proximal to the flicker element;

each said paddle element comprising at least one body portion having at least one reflective surface thereon, said at least one reflective surface comprising a central region and a perimeter region at least partially located around the central region, the perimeter region at least partially defining a perimeter plane;

the paddle elements being located in the respective locations therefor to position the perimeter plane substantially perpendicular to the axis, for intermittently reflecting the light from said at least one light source therefrom as the rod is rotated;

the central region being substantially non-planar and the perimeter region being at least partially planar, to cause the light reflected therefrom to the screen as the flicker element rotates to have varying intensity on the screen;

the perimeter region comprising at least one middle part and at least one side part, said at least one middle part being at least partially defined by at least one channel partially separating said at least one middle part and said at least one side part;

said at least one side part comprising a first side part and a second side part;

said at least one channel comprising first and second channels; and said at least one middle part is at least partially defined by the first and second channels, the first channel being located between said at least one middle part and the first side part, and the second channel being located between said at least one middle part and the second side part.

8. A method of providing images of flames comprising:

(a) providing at least one light source for producing light;

(b) providing a screen for displaying a plurality of images of flames in at least one predetermined region thereof;

(c) providing at least one simulated fuel element proximal to a front surface of the screen;

(d) providing a rotatable flicker element located behind the screen, comprising:

an elongate rod defined by an axis thereof, the rod being positionable to locate the axis at a preselected elevation above a base of the flame simulating assembly and horizontally spaced apart from said at least one simulated fuel element;

a plurality of paddle elements located in respective locations on the rod;

(e) providing a holding bracket for locating said at least one light source at the preselected elevation;

(f) rotating the flicker element about the axis;

(g) positioning said at least one simulated fuel element to at least partially conceal the holding bracket;

(h) providing a flame effect element for configuring the light from said at least one light source that is reflected toward said at least one predetermined region above said at least one simulated fuel element to provide the images of flames therein;

(i) energizing said at least one light source, the light therefrom being at least partially directed through the flame effect element to said at least one predetermined region, to provide the images of flames therein above said at least one simulated fuel element; and (j) permitting the light from said at least one light source that is reflected from the flicker element toward at least one lower region of the screen that is located below said at least one simulated fuel element to avoid the flame effect element, to provide a glowing effect in said at least one lower region.

9. The method according to claim 8 additionally comprising:

(k) providing at least one simulated ember bed; and (l) positioning said at least one simulated ember bed at least partially below said at least one simulated fuel element.

10. The method according to claim 9, additionally comprising:

(m) providing at least one ember bed light source;

(n) positioning said at least one ember bed light source for directing ember bed light therefrom inside said at least one ember bed; and (o) energizing said at least one ember bed light, for simulating glowing embers in the simulated ember bed.

* * * * *